US006789449B2

(12) United States Patent
Liu

(10) Patent No.: US 6,789,449 B2
(45) Date of Patent: Sep. 14, 2004

(54) RATCHET WRENCH

(76) Inventor: Lin-Lang Liu, P.O. Box 82-144, Taipei (TW)

( * ) Notice: Subject to any disclaimer, the term of this patent is extended or adjusted under 35 U.S.C. 154(b) by 0 days.

(21) Appl. No.: 10/338,868

(22) Filed: Jan. 9, 2003

(65) Prior Publication Data

US 2004/0134313 A1 Jul. 15, 2004

(51) Int. Cl.[7] ..... B25B 13/46

(52) U.S. Cl. ..... 81/63.2; 81/63.1; 81/57.29; 81/58; 81/58.1; 192/43; 192/46

(58) Field of Search ..... 81/63.2, 63.1, 81/57.29, 58, 58.1, 60, 61, 62; 192/43, 43.1, 43.2, 46

(56) References Cited

U.S. PATENT DOCUMENTS 5,626,062 A * 5/1997 Colvin ..... 81/63.2
6,164,167 A * 12/2000 Chen ..... 81/63.2
6,408,722 B1 * 6/2002 Chen ..... 81/60
6,453,779 B2 * 9/2002 Hu ..... 81/63
6,457,388 B1 * 10/2002 Chen ..... 81/63.2
6,457,389 B1 * 10/2002 Hu ..... 81/63.2
6,516,690 B2 * 2/2003 Chen ..... 81/63

* cited by examiner

*Primary Examiner*—Joseph J. Hail, III
*Assistant Examiner*—Alvin J Grant
(74) *Attorney, Agent, or Firm*—Leong C. Lei

(57) ABSTRACT

A ratchet wrench is disclosed. The ratchet wrench is characterized in that the head portion has a tool connector cavity, and has a ratchet cavity adjacent to one side of the handle for communication with the tool connector, the ratchet block is positioned within the ratchet block cavity which can automatically move forward, the top face of the head portion corresponding to the top edge of the ratchet cavity is a notch for engaging with a covering plate; the middle section of the external edge is a tool connector is formed into a position-limiting circular slot, and the ratchet block having a ratchet wall with ratchet teeth is provided with position-limiting block which can correspondingly engage with the circular slot, and the top face of the ratchet block is protruded with a trigger rod passed through the covering plate, and the center of the covering plate is a corresponding T-shaped trigger recess, thereby a ratchet wrench is obtained. When the ratchet block urges the tool connector, the urging force of the position-limiting protruded block is increased and the anti-torsional force is improved and the ratchet block moves backward facilitating the replacement of tool connector.

1 Claim, 7 Drawing Sheets

RATCHET WRENCH

BACKGROUND OF THE INVENTION (a) Technical Field of the Invention

The present invention relates to a ratchet wrench, and in particular, to a wrench employing a ratchet block to change the direction of rotation of a tool.

(b) Description of the Prior Art

FIGS. 1 and 2 show a conventional ratchet wrench having a handle 10 with a head portion 11. The head portion is provided with a tool connector cavity 12, and the head portion 11 and the handle 10 are in communication with the cavity 12 of the tool connector 20 and between the head portion 11 and the handle 10, a ratchet block cavity 13 and a trigger block cavity 14 are in communication with the tool connector cavity 12.

The ratchet block cavity 13 and the trigger block cavity 14 are adapted for the ratchet block 22 and the trigger block 15. The bottom face of the trigger block cavity 14 is a pivotal slot 140. The wall face of the trigger block cavity 14 is a cavity hole 141 extended toward the handle 10. The cavity hole 141 can adapt a top peg 160 and an elastic element 161. The wall face of the trigger block 15 is formed into a trigger arch edge 151 for positioning of the trigger block 15. The bottom face of the trigger block 15 is a pivotal block 150 corresponding to a pivotal slot 140.

The extended edge of the trigger block 15 is provided with a cavity hole 152 containing a top peg 170 for supporting the ratchet block 22 and an elastic element 171. The wall face corresponding to the ratchet block 22 is a positioning arch edge 23, and the external edge of the tool connector 20 is formed into a ratchet teeth 21 corresponding to the ratchet block 22, and the ratchet block 22 is used for the positioning of the rotation of the tool connector 20. The top edge of the recess 12 is provided with a position-limiting structure 25 for locking the tool connector 20 within the head portion 11.

The drawbacks of the conventional ratchet wrench are as follows:

The components for forming a ratchet wrench are too many, and therefore the cost of production is high;

The scope of tolerance is small and therefore, a small error will cause an ineffective operation of the ratchet wrench; and The anti-torsional force is insufficient.

The tool connector cannot be replaced due to the use of the position-limiting structure 25 to lock the tool connector 20 within the head portion 11.

Taiwanese Patent Publication No. 382300 discloses a ratchet wrench having a single-sided engagement to achieve the replacement of the tool connector. The disadvantage of this conventional ratchet wrench is that only a fastener is used to restrict the position and if the fastener is knocked or touched, the tool connector will be disengaged and therefore, it is inconvenient to use.

Accordingly, it is an object of the present invention to provide a ratchet wrench to mitigate the above drawbacks.

SUMMARY OF THE INVENTION

Accordingly, it is an object of the present invention to provide a ratchet wrench which will increase the anti-torsional force of the ratchet wrench.

Another object of the present invention is to provide a ratchet wrench having a handle end portion forming into a head portion containing a tool connector and a ratchet block, characterized in that the head portion has a tool connector cavity, and has a ratchet cavity adjacent to one side of the handle for communication with the tool connector, the ratchet block is positioned within the ratchet block cavity which can automatically move forward, the top face of the head portion corresponding to the top edge of the ratchet cavity is a notch for engaging with a covering plate; the middle section of the external edge is a tool connector formed into a position-limiting circular slot, and the ratchet block having a ratchet wall with ratchet teeth is provided with position-limiting block which can correspondingly engage with the circular slot, and the top face of the ratchet block is provided with a trigger rod extending through the covering plate, and the center of the covering plate has a corresponding T-shaped trigger recess, thereby obtaining a ratchet wrench.

Yet a further object of the present invention is to provide a ratchet wrench having a handle end portion forming into a head portion containing a tool connector and a ratchet block, characterized in that the head portion has a tool connector cavity, and has a ratchet cavity adjacent to one side of the handle for communication with the tool connector, the ratchet block is positioned within the ratchet block cavity which can automatically move forward, the top face of the head portion corresponding to the top edge of the ratchet cavity is a notch for engaging with a covering plate, wherein the external edge of the tool connector is a series of ratchet teeth and the ratchet block is engageable with the tool connector, and the top face of the ratchet block is provided with a trigger rod extending through the covering plate, and the center of the covering plate has a corresponding traverse trigger slot, thereby obtaining a ratchet wrench.

Other objects, and advantages of the present invention can be more fully understood by reading the following detailed description of the preferred embodiment, with reference to the accompanying.

DETAILED DESCRIPTION OF THE PREFERRED EMBODIMENTS

Figure 1:
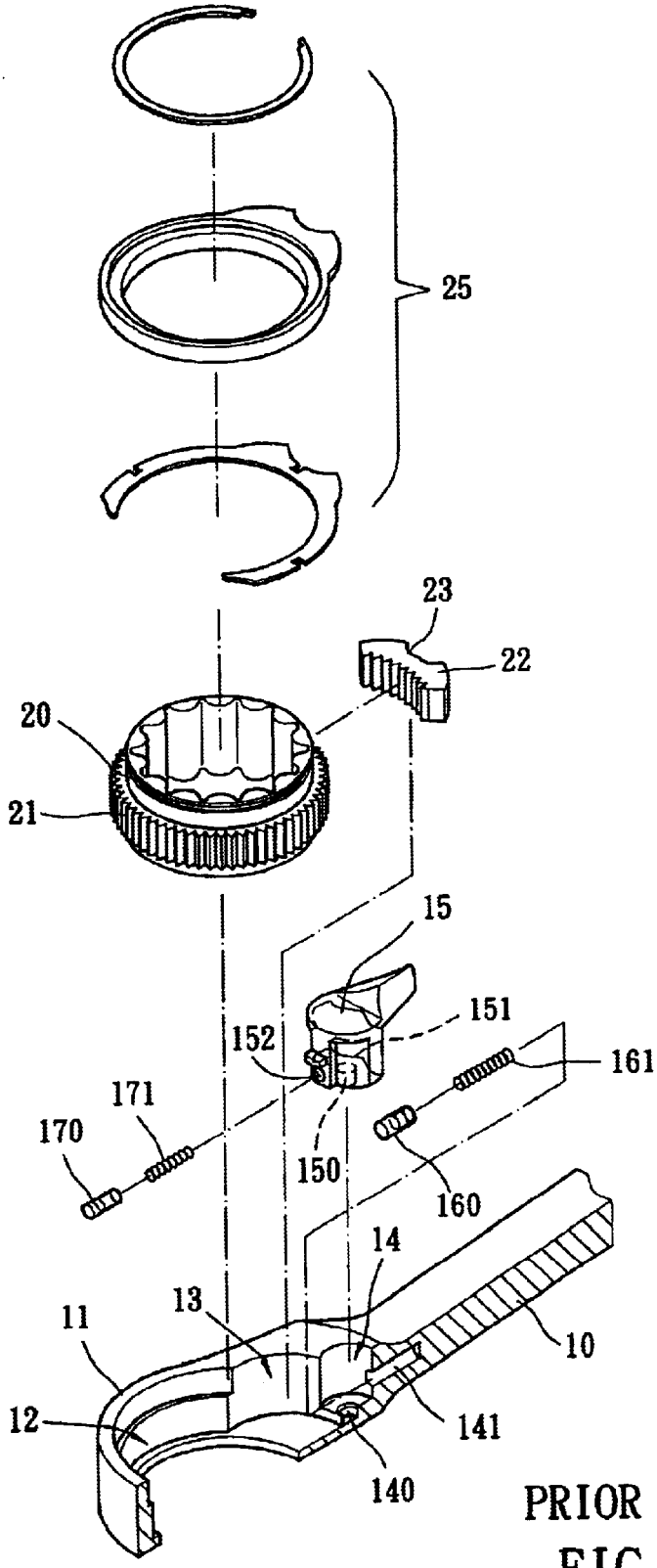
PRIOR ART FIG. 1
FIG. 1 is a perspective exploded view of a conventional ratchet wrench.
Figure 2:
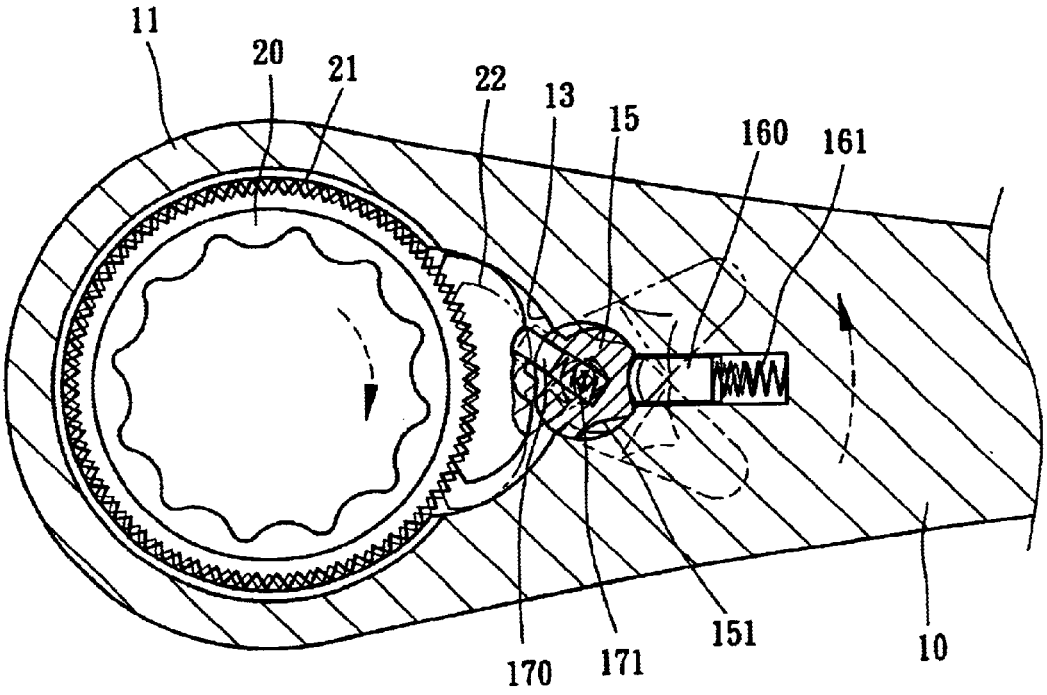
PRIOR ART FIG. 2
FIG. 2 is a plan view of a conventional ratchet wrench.
Figure 3:
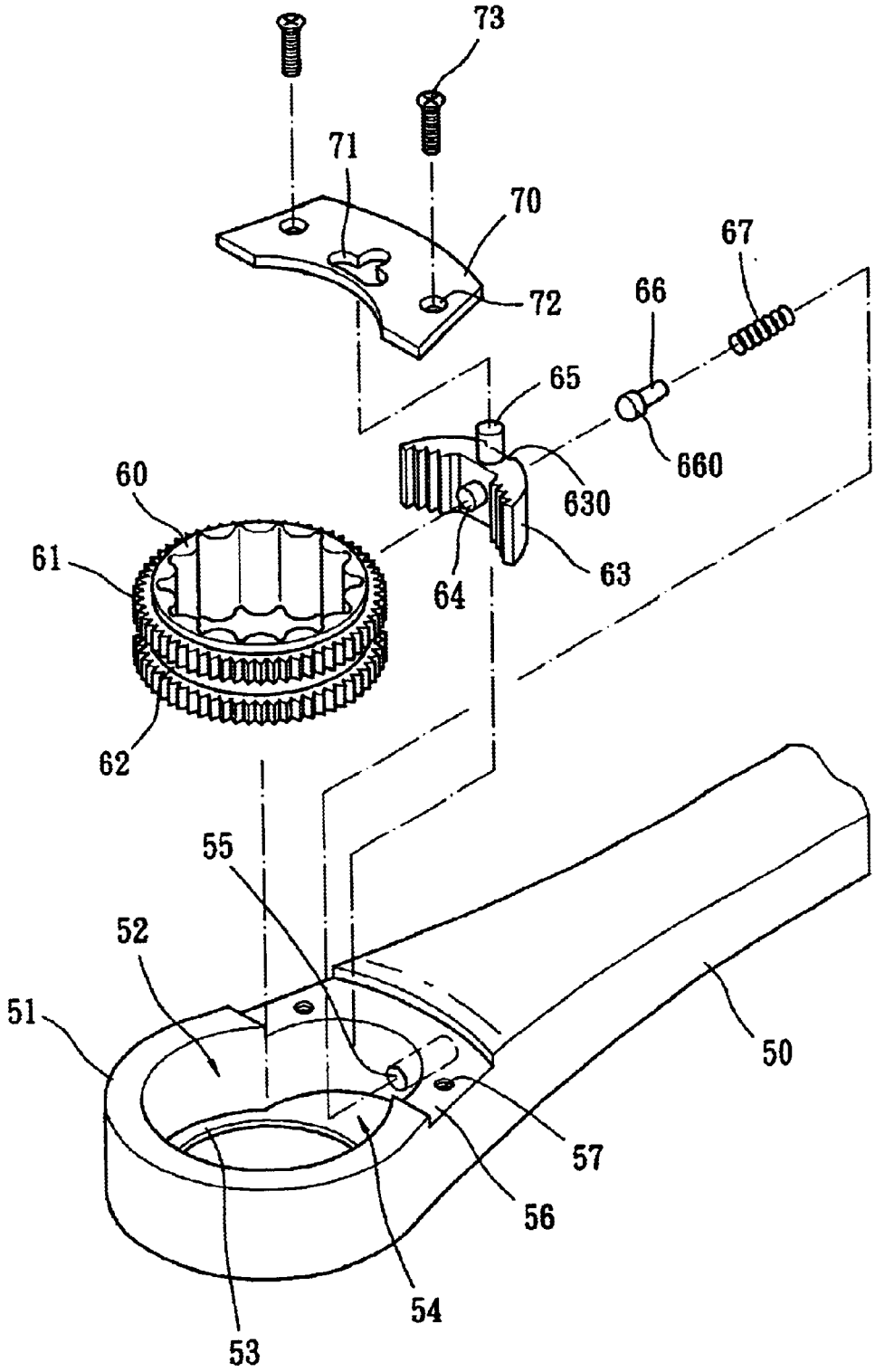
FIG. 3 is a perspective exploded view of the ratchet wrench of the present invention.
Figure 4D:
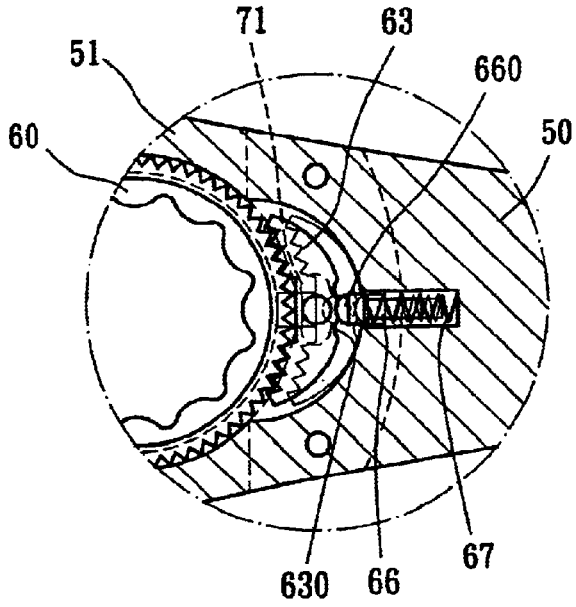
FIG. 4 is a schematic view showing the first embodiment of the present invention.
Figure 4C:
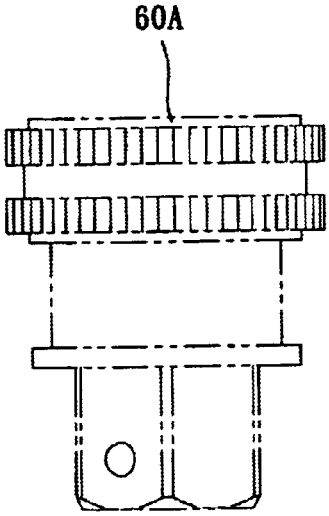
Figure 4B:
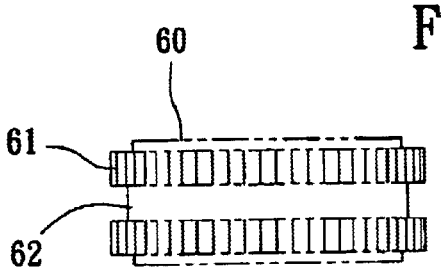
Figure 4A:
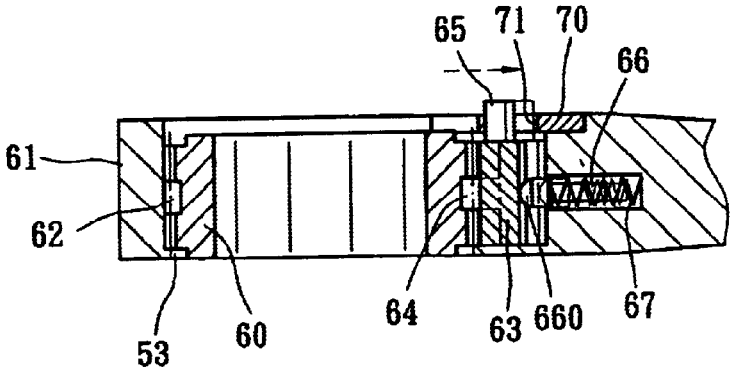

Referring to FIGS. 3 and 4, there is shown a ratchet wrench, in accordance with the present invention, having a handle 50 with an end portion being formed into a large head portion 51.

The head portion 51 can contain a tool connector 60 and a ratchet block 63, and the ratchet block 63 is used to control the empty rotation and direction of the position of the tool connector 60.

The head portion 51 has a tool connector cavity 52, and has a ratchet block cavity 54 adjacent to one side of the handle for communication with the tool connector cavity 52, and the ratchet block 63 is positioned within the ratchet block cavity 54 which can automatically move forward, and the top face of the head portion 51 corresponding to the top edge of the ratchet block cavity 54 has a notch 56 for engaging with a covering plate 70. A radial blind hole 55 is formed in the head portion 51 and has an open end in communication with the ratchet block cavity 54.

The bottom edge of the tool connector cavity has a protruded circular plate 53 for receiving the tool connector 60.

The top face of the two sides of the notch 56 is provided with screw holes 57, and the covering plate 70 is correspondingly provided with through holes 72 and the covering plate 70 is locked to the head portion 51 with bolts 73.

The middle section of the external edge of the tool connector 60 is formed with a position-limiting circular slot 62 and the ratchet block 63 has a corresponding position-limiting protruded block 64.

As shown in FIG. 4, when the tool connector 60 is to be replaced with a tool connector 60A, the trigger rod 65 of the ratchet block 63 is pushed to the back 630 of the trigger slot 71 of the covering plate 70 and the ratchet block 63 will move simultaneously backward, and the position-limiting protruded block 64 of the ratchet block 63 disengages from the position-limiting circular slot 62 of the tool connector 60, and therefore the tool connector 60 is withdrawn and a new tool connector 60A is replaced. Finally, the trigger rod 65 is released and the ratchet block 63 will be restored to its original position by the restoration spring 67 and the locking rod 66 such that the position-limiting protruded block 64 is engaged again with the circular slot 62 and the tool connector 60A is positioned. Thus, the tool connector 60 can be replaced with the tool connector 60A.

Figure 5:
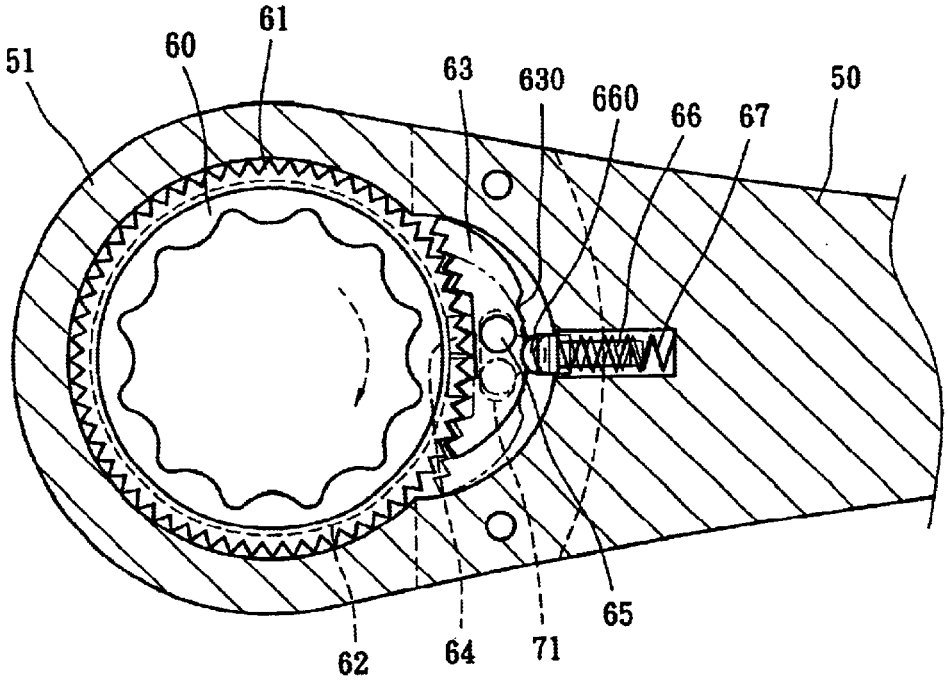
FIG. 5 is a schematic view showing the second embodiment of the present invention.

As shown in FIG. 5, if the tool connector 60 is fixedly engaged with the ratchet block 63, the anti-torque is absorbed by the protruded block 64 and the circular slot 62 without causing damage to the ratchet teeth 61. Therefore, the teeth 61 will not be damaged and the longevity of the wrench is extended.

Figure 6:
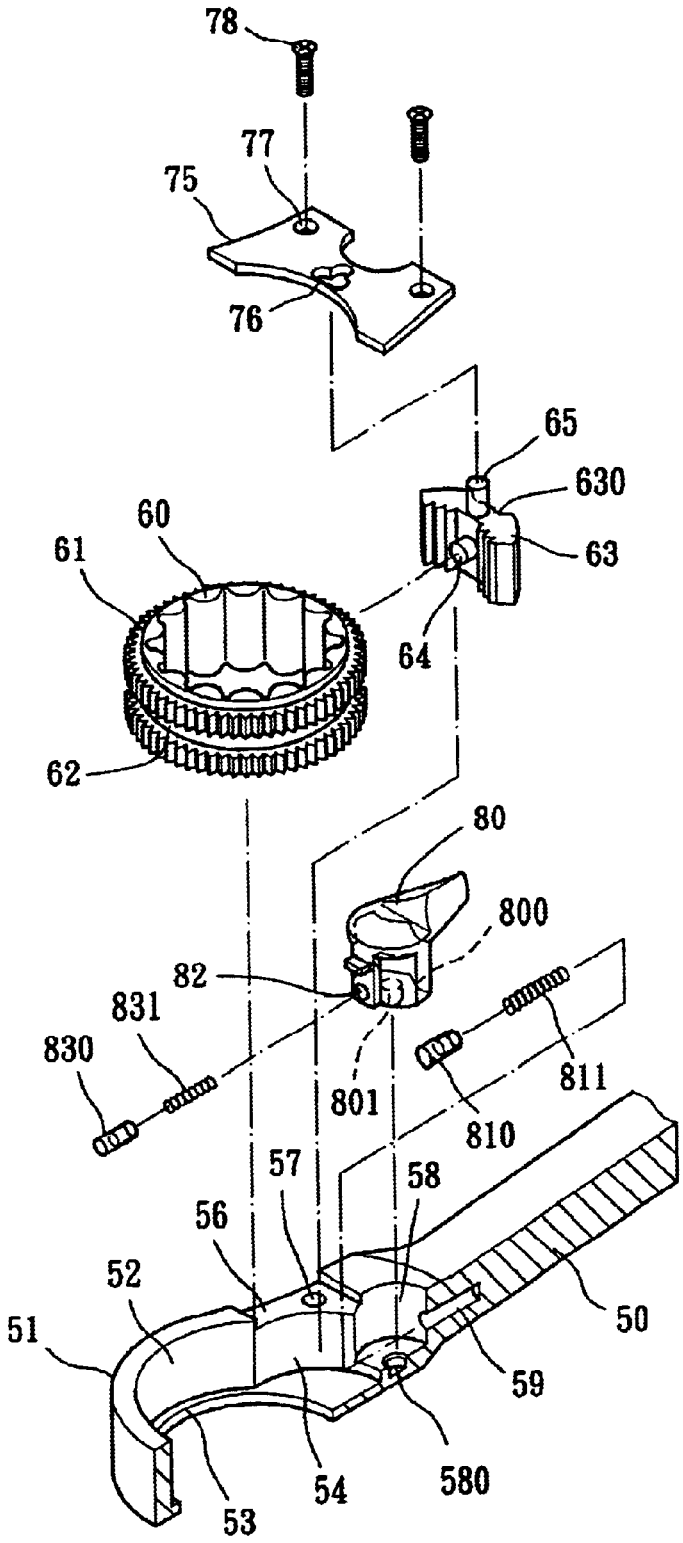
FIG. 6 is a perspective exploded view of another preferred embodiment.
Figure 7:
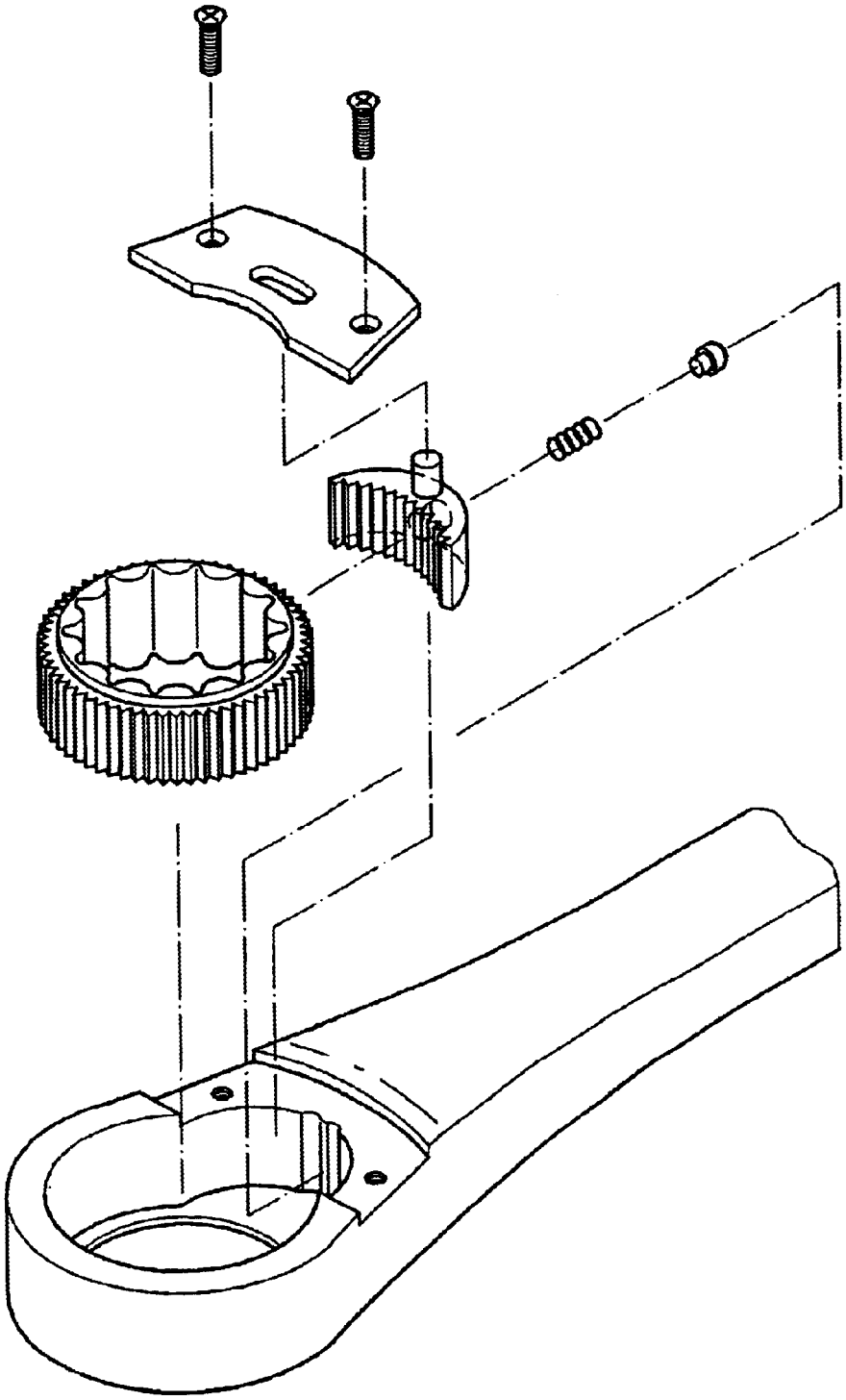
FIG. 7 is a perspective exploded view of a further preferred embodiment in accordance with the present invention.

FIG. 6 is another preferred embodiment wherein the rear of the ratchet block cavity 54 has a trigger block cavity 58 in which is fitted a trigger block 80, and the center of the bottom face has a pivotal slot 580. The head portion 51 is provided with a cavity hole 59, and the rear edge of the trigger block 80 is formed into a triggered positioned arch edge 800 for the positioning of the top peg 810 and the elastic element 811. The bottom face of the trigger block 80 has a pivotal block 801 which can be mounted within the pivotal slot 580. The front edge of the trigger block 80 has a recess 82 in which are fitted a top peg 830 and an elastic element 831. The top peg 830 can urge the position arch edge 630 and a covering plate 75 can be mounted on the ratchet block 63 and the trigger block 80 is mounted within the head portion 51, and the through hole 77 and the screw bolt 78 are used to lock at the head portion. The top face is provided with a T-shaped trigger slot, thereby the trigger block 80 is used to trigger the ratchet block so as to control the direction of the rotation of the tool connector 60 and is directly triggering downward the trigger rod 65 of the ratchet block 65. Thus, the replacement of the tool connectors 60, 60A is achieved.

The advantages of the ratchet wrench of the present invention are as follows:

Low cost of production

Due to the fact that the components of the ratchet wrench are simple and the yield of production is high. Therefore, the cost of production of the ratchet wrench is low.

Actuation of the ratchet wrench is accurate. When the ratchet wrench is applied onto a tool, in appropriate rotation of the wrench will not occur.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. A ratchet wrench comprising a handle having an end formed with a head portion, a tool connector and a ratchet block, wherein said head portion having a tool connector cavity, a ratchet block cavity in communication with said tool connector cavity, and a radial blind hole in communication with said ratchet block cavity, a top edge of said ratchet block cavity having a notch engaged with a covering plate, a bottom edge of said tool connector cavity having a protruded circular plate for receiving said tool connector, a middle section of an external edge of said tool connector being formed with a position-limiting circular slot, said external edge of said tool connector having a plurality of teeth, said ratchet block having a plurality of teeth engageable with said teeth of said tool connector, a position-limiting protruded block fitted in said position-limiting circular slot of said tool connector, and a trigger rod extending upwardly out of a trigger slot of said covering plate, a spring fitted in said radial blind hole, a locking rod pushed by said spring against said ratchet block thereby urging said ratchet block to engage with said tool connector.

* * * * *